US009310721B2

(12) United States Patent
Yokoyama

(10) Patent No.: US 9,310,721 B2
(45) Date of Patent: Apr. 12, 2016

(54) IMAGE FORMING APPARATUS HAVING TONER HEATING UNIT

(71) Applicant: FUJI XEROX CO., LTD., Tokyo (JP)

(72) Inventor: Yuki Yokoyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/463,021

(22) Filed: Aug. 19, 2014

(65) Prior Publication Data

US 2015/0268603 A1 Sep. 24, 2015

(30) Foreign Application Priority Data

Mar. 20, 2014 (JP) ..... 2014-058046
Mar. 20, 2014 (JP) ..... 2014-058047

(51) Int. Cl.

*G03G 15/10* (2006.01)
*G03G 15/01* (2006.01)
*G03G 15/11* (2006.01)
*G03G 15/16* (2006.01)
*G03G 15/20* (2006.01)

(52) U.S. Cl.

CPC ..... *G03G 15/11* (2013.01); *G03G 15/10* (2013.01); *G03G 15/161* (2013.01); *G03G 15/169* (2013.01); *G03G 15/2007* (2013.01); *G03G 15/2021* (2013.01); *G03G 2215/0119* (2013.01)

(58) Field of Classification Search

CPC ... G03G 15/10; G03G 15/11; G03G 15/0178; G03G 15/0189; G03G 15/0194; G03G 2215/0658; G03G 15/1665; G03G 15/161; G03G 15/169; G03G 15/2021; G03G 2215/0119

USPC ..... 399/57, 223, 237, 251, 296, 298, 302, 399/303

See application file for complete search history.

(56) References Cited

U.S. PATENT DOCUMENTS

| | | | | |
|---|---|---|---|---|
| 6,064,411 | A * | 5/2000 | van Sas et al. | 347/115 |
| 6,141,026 | A * | 10/2000 | Domoto et al. | 347/140 |
| 6,259,880 | B1 * | 7/2001 | Jia et al. | 399/307 |
| 2002/0090231 | A1 * | 7/2002 | Ooka et al. | 399/237 |
| 2008/0299480 | A1 * | 12/2008 | Akioka | G03G 9/125 430/113 |
| 2009/0035458 | A1 * | 2/2009 | Yoshie | 427/145 |
| 2012/0224879 | A1 * | 9/2012 | Fujita et al. | 399/94 |
| 2013/0011171 | A1 * | 1/2013 | Tamura | G03G 15/2021 399/321 |
| 2014/0242513 | A1 * | 8/2014 | Tatsuura et al. | 430/112 |
| 2015/0016852 | A1 * | 1/2015 | Katsuta et al. | 399/320 |

FOREIGN PATENT DOCUMENTS

| | | | |
|---|---|---|---|
| JP | 53-057039 | A * | 5/1978 |
| JP | 05-100602 | A * | 4/1993 |
| JP | 2002072693 | A * | 3/2002 |
| JP | 2002082504 | A * | 3/2002 |
| JP | A-2003-098864 | | 4/2003 |

* cited by examiner

*Primary Examiner* — Robert Beatty
(74) *Attorney, Agent, or Firm* — Oliff PLC

(57) ABSTRACT

An image forming apparatus includes a plurality of image forming sections that form a toner image on a medium to be fed using a developer containing toner and non-volatile oil, and a heating unit that is arranged on a downstream side of an image forming section, which is arranged on an upstream side in a feeding direction of the medium, and on an upstream side of an image forming section, which is arranged on a downstream side in the feeding direction, among the plurality of image forming sections, wherein the heating unit heats the toner on the medium to a melting temperature of the toner or higher.

5 Claims, 4 Drawing Sheets

IMAGE FORMING APPARATUS HAVING TONER HEATING UNIT

CROSS-REFERENCE TO RELATED APPLICATIONS

This application is based on and claims priority under 35 USC 119 from Japanese Patent Application Nos. 2014-058047 and 2014-058046, filed Mar. 20, 2014.

BACKGROUND

Technical Field

The present invention relates to an image forming apparatus.

SUMMARY

According to an aspect of the invention, there is provided an image forming apparatus including:

a plurality of image forming sections that form a toner image on a medium to be fed using a developer containing toner and non-volatile oil; and a heating unit that is arranged on a downstream side of an image forming section, which is arranged on an upstream side in a feeding direction of the medium, and on an upstream side of an image forming section, which is arranged on a downstream side in the feeding direction, among the plurality of image forming sections, wherein the heating unit heats the toner on the medium to a melting temperature of the toner or higher.

BRIEF DESCRIPTION OF THE DRAWINGS

Exemplary embodiments of the present invention will be described in detail based on the following figures, wherein.

DETAILED DESCRIPTION

Overall Configuration of Image Forming Apparatus

Summary

Hereinafter, an example of an image forming apparatus according to an exemplary embodiment of the invention will be described using FIG. 1. First, the overall configuration and operation of the image forming apparatus will be described. Next, effects of a major component (heating device) according to the exemplary embodiment will be described.

Figure 1:
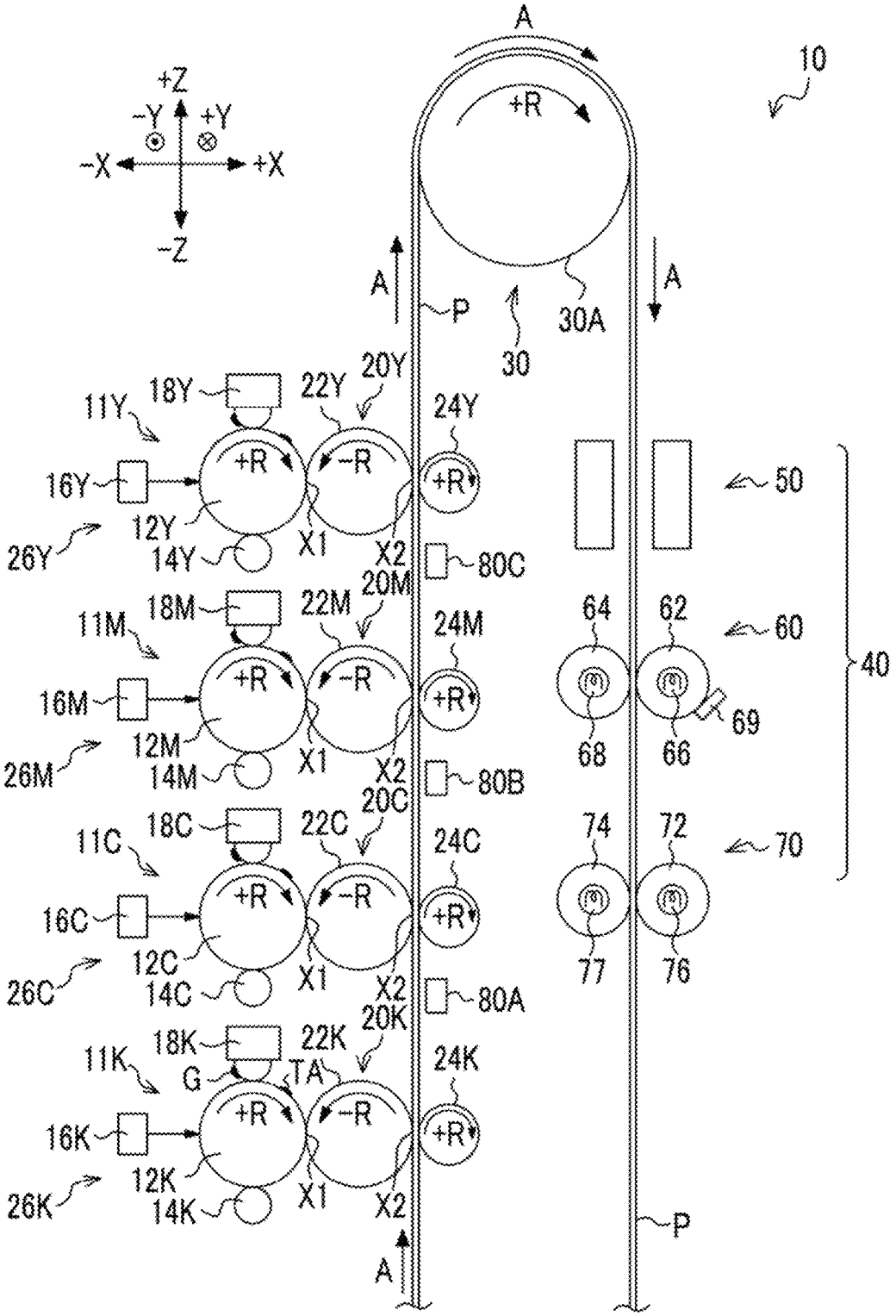
FIG. 1 is a schematic diagram (front view) illustrating an image forming apparatus according to an exemplary embodiment of the invention.

In the following description, a direction indicated by arrow Z in FIG. 1 is a height direction of the apparatus, and a direction indicated by arrow X in FIG. 1 is a width direction of the apparatus. In addition, a direction (indicated by Y) perpendicular to the height and width directions is a depth direction of the apparatus. When the image forming apparatus 10 is seen from the front side, the height direction, the width direction, and the depth direction of the apparatus will be referred to as "Z direction", "X direction", and "Y direction", respectively.

In a case where it is necessary to distinguish one side and the other side of each of the X, Y, and Z directions from each other, when the image forming apparatus 10 is seen from the front side, an upper side will be referred to as "+Z side", a lower side will be referred to as "−Z side", a right side will be referred to as "+X side", a left side will be referred to as "−X side", a depth side will be referred to as "+Y side", and a front side will be referred to as "−Y side".

The image forming apparatus 10 includes a feeding device 30, four image forming sections 26K, 26C, 26M, and 26Y, three heating devices 80A, 80B, and 80C, a fixing device 40, and a controller (not illustrated). The suffix "K" refers to black, the suffix "C" refers to cyan, the suffix "M" refers to magenta, and the suffix "Y" refers to yellow. In addition, in the image forming apparatus 10, the image forming sections 26K, 26C, 26M, and 26Y corresponding to the respective colors are arranged in order of K, C, M, and Y from an upstream side in a feeding direction of the medium P described below. The operation of each component of the image forming apparatus 10 is controlled by the controller (not illustrated).

Feeding Device

The feeding device 30 has a function of feeding a medium P in a direction (feeding direction) indicated by arrow A at a predetermined feeding speed. The medium P is continuous paper and, for example, is fed from the −Z side to the +Z side on an upstream side of a feeding roll 30A in the feeding direction and is fed from the +Z side to the −Z side on a downstream side of the feeding roll 30A in the feeding direction. In addition, in the feeding direction of the medium P, the feeding roll 30A is arranged on a downstream side of four image forming units 11K, 11C, 11M, and 11Y and four transfer devices 20K, 20C, 20M, and 20Y, and the fixing device 40 is arranged on a downstream side of the feeding roll 30A.

Image Forming Section

The image forming sections 26K, 26C, 26M, and 26Y have a function of forming a toner image on the medium P, which is fed by the feeding device 30, using a developer containing toner T and non-volatile oil O. The image forming sections 26K, 26C, 26M, and 26Y include image forming units 11K, 11C, 11M, and 11Y and transfer devices 20K, 20C, 20M, and 20Y, respectively. In the following description, when it is not necessary to distinguish toner colors (K, C, M, Y) from one another in the image forming sections 26K, 26C, 26M, and 26Y and the respective members included in these image forming sections, the suffixes K, C, M, and Y will be omitted.

Image Forming Unit

The image forming unit 11 includes a photoreceptor drum 12, a charging device 14, an exposure device 16, and a developing device 18. Charging devices 14K, 14C, 14M, and 14Y, exposure devices 16K, 16C, 16M, and 16Y, and developing devices 18K, 18C, 18M, and 18Y are arranged around photoreceptor drums 12K, 12C, 12M, and 12Y in this order in the +R direction, respectively.

Photoreceptor Drum

The photoreceptor drum 12 has a function of holding the toner image which is developed by the developing device 18.

The photoreceptor drum 12 is formed in a cylindrical shape and rotary driven around its axis (direction (clockwise direction) indicated by arrow +R) by driving means (not illustrated). The photoreceptor drum 12 includes an aluminum substrate and a photosensitive layer (not illustrated) in which an undercoating layer, a charge generation layer, and a charge transport layer are formed in this order on the substrate.

Charging Device

The charging device 14 has a function of charging an outer peripheral surface of the photoreceptor drum 12. The charging device 14 is arranged along the axis direction (Y direction) of the photoreceptor drum 12. In the exemplary embodiment, the charging device 14 is a charging roll.

Exposure Device

The exposure device 16 has a function of forming a latent image on the outer peripheral surface of the photoreceptor drum 12 which is charged by the charging device 14. The exposure device 16 emits exposure light from a light emitting diode array (not illustrated) according to image data received from an image signal processing unit (not illustrated). The outer peripheral surface of the photoreceptor drum 12 charged by the charging device 14 is irradiated with this exposure light to form the latent image on the outer peripheral surface.

Developing Device

The developing device 18 has a function of developing the latent image, which is formed on the photoreceptor drum 12, using the developer containing the toner T and the non-volatile oil O to form a toner image. The developing device 18 is arranged along the axis direction (Y direction) of the photoreceptor drum 12.

Transfer Device

The transfer device 20 has a function of secondarily transferring the toner image, which is primarily transferred from the photoreceptor drum 12, onto the medium P to be fed. The transfer device 20 includes an intermediate transfer roll 22 and a backup roll 24.

Intermediate Transfer Roll

The intermediate transfer roll 22 is in contact with the photoreceptor drum 12 and is rotated in a direction indicated by arrow −R (counterclockwise direction) in a primary transfer position X1 which is positioned on an upstream side of the charging device 14 and on a downstream side of the developing device 18 in the rotating direction of the photoreceptor drum 12. As a result, the transfer device 20 primarily transfers the toner image, which is formed on the outer peripheral surface of the photoreceptor drum 12, from the primary transfer position X1 to the intermediate transfer roll 22. A primary transfer voltage (bias voltage) is applied between the photoreceptor drum 12 and the intermediate transfer roll 22 by a power source (not illustrated). In addition, when the toner image is primarily transferred to the medium P, the oil O (refer to FIG. 3A) is also transferred to the medium P.

Backup Roll

The backup roll 24 is arranged on a side opposite the photoreceptor drum 12 to be opposite the intermediate transfer roll 22. The backup roll 24 forms a nip with the intermediate transfer roll 22 and is rotated in the direction indicated by arrow +R along with the rotation of the intermediate transfer roll 22. Here, a position where the intermediate transfer roll 22 is in contact with the medium P is a secondary transfer position X2, and the toner image which is primarily transferred to the intermediate transfer roll 22 is secondarily transferred at the secondary transfer position X2 to the medium P. A secondary transfer voltage (bias voltage) is applied between the intermediate transfer roll 22 and the backup roll 24. In addition, when the toner image is secondarily transferred to the medium P, the oil O (refer to FIG. 3A) is also transferred to the medium P.

Heating Device

The heating device 80A has a function of heating toner T included in a toner image, which is formed on the medium P by the image forming section 26K, to a melting temperature of the toner T or higher. In other words, the heating device 80A has a function of heating toner T included in a toner image, which is formed on an upstream side of the heating device 80A in the feeding direction of the medium P, to a melting temperature of the toner T or higher. The heating device 80A is arranged on a downstream side of the image forming section 26K and on an upstream side of the image forming section 26C in the feeding direction of the medium P (direction indicated by arrow A). In addition, the heating device 80A is arranged so as not to come into contact with a surface of the medium P to be fed on a side thereof where the backup roll 24 is present.

The heating device 80B has a function of heating toner T included in a toner image, which is formed on the medium P by the image forming sections 26K and 26C, to a melting temperature of the toner T or higher. The heating device 80B is arranged on a downstream side of the image forming section 26C and on an upstream side of the image forming section 26M in the feeding direction of the medium P. In addition, the heating device 80B is arranged so as not to come into contact with a surface of the medium P to be fed on a side thereof where the backup roll 24 is present.

The heating device 80C has a function of heating toner T included in a toner image, which is formed on the medium P by the image forming sections 26K, 26C, and 26M, to a melting temperature of the toner T or higher. The heating device 80C is arranged on a downstream side of the image forming section 26M and on an upstream side of the image forming section 26Y in the feeding direction of the medium P. In addition, the heating device 80C is arranged so as not to come into contact with a surface of the medium P to be fed on a side thereof where the backup roll 24 is present.

Here, each of the heating devices 80A, 80B, and 80 is an example of the heating unit. In the following description, when it is not necessary to distinguish the heating devices 80A, 80B, and 80C from each other, the suffixes "A", "B", and "C" will be omitted. In the exemplary embodiment, the heating devices 80A, 80B, and 80C are infrared heaters.

Definition of Melting Temperature of Toner and Measurement Method Thereof

The melting temperature of the toner T is a peak temperature of an endothermic peak (main peak) obtained by the following measurement. The melting temperature of the toner T is measured using a DSC calorimeter (differential scanning calorimeter DSC-7, manufactured by PerkinEimer Co., Ltd.) according to ASTMD 3418-8. Melting temperatures of indium and zinc are used to correct the temperature of a detecting unit of the DSC calorimeter, and heat of fusion of indium was used to correct the amount of heat. The melting temperature of the toner T is measured at a temperature increase rate of 10° C./min by using an aluminum pan and setting an empty pan for a control. In the exemplary embodiment, the melting temperature of the toner T is, for example, 110° C.

Fixing Device

The fixing device 40 includes an auxiliary heating section 50, an oil removal section 60, and a fixing section 70. In addition, the auxiliary heating section 50, the oil removal section 60, and the fixing section 70 are arranged from an upstream side to a downstream side in the feeding direction of the medium P.

Auxiliary Heating Section

The auxiliary heating section 50 has a function of auxiliary heating the medium P, the toner image on the medium P, and the oil O on an upstream side of the fixing section 70 in the feeding direction of the medium P. The auxiliary heating sections 50 are arranged on both sides of the medium P to be fed with the medium P interposed therebetween. In the exemplary embodiment, the auxiliary heating section 50 is an infrared heater that heats the medium P and the toner image on the medium P without contact.

Oil Removal Section

The oil removal section 60 has a function of removing the oil O on the medium P. The oil removal section 60 includes a metal roll 62, a pressure roll 64, a halogen heater 66, a halogen heater 68, and a collection blade 69.

The metal roll 62 and the pressure roll 64 are arranged opposite to each other with the medium P interposed therebetween. In addition, the metal roll 62 and the pressure roll 64 are formed in a cylindrical shape, respectively. The halogen heater 66 is arranged inside the metal roll 62 and has a function of heating the metal roll 62. The halogen heater 68 is arranged inside the pressure roll 64 and has a function of heating the pressure roll 64. The metal roll 62 has a function of rotating while being in contact with the heated oil O on the medium P to be fed. The collection blade 69 is in contact with the outer peripheral surface of the metal roll 62 and has a function of collecting the oil O transferred to the outer peripheral surface of the metal roll 62. The oil removal section 60 removes the oil on the medium P before the toner image is fixed on the medium P.

Fixing Section

The fixing section 70 has a function of fixing the toner image, formed on the medium P, on the medium P. The fixing section 70 includes a fixing roll 72, a pressure roll 74, a halogen heater 76, and a halogen heater 77.

The fixing roll 72 and the pressure roll 74 are arranged opposite to each other with the medium P interposed therebetween. The fixing roll 72 and the pressure roll 74 are formed in a cylindrical shape, respectively. The pressure roll 74 has a function of pressing the medium P against the fixing roll 72. The halogen heater 76 is arranged inside an inner peripheral surface of the fixing roll 72 and has a function of heating the fixing roll 72. The halogen heater 77 is arranged inside an inner peripheral surface of the pressure roll 74 and has a function of heating the pressure roll 74. When being pressed by the pressure roll 74, the fixing roll 72 is dented and forms a nip with the medium P. The fixing section 70 fixes the toner image, which is formed on the medium P passing through the nip, on the medium P using the fixing roll 72.

Developer

Figure 3A:
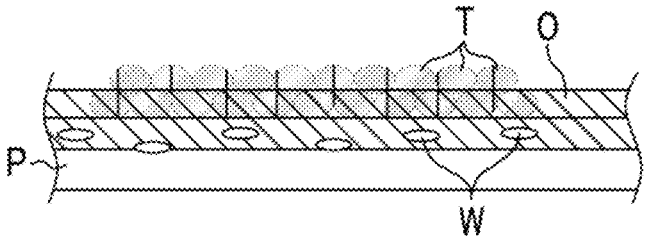
FIGS. 3A to 3D are schematic diagrams (cross-sectional views) illustrating a state of a developer and a medium when toner included in a toner image, which is formed on a medium by an image forming section according to an exemplary embodiment of the invention, is heated by a heating device.

The developer used in the exemplary embodiment is a liquid developer in which the powdered toner T (refer to FIG. 3A) is dispersed in the oil O (refer to FIG. 3A). In the exemplary embodiment, the toner T contains, for example, a polyester resin as a major component. In addition, the oil O contains, for example, dimethyl silicone oil (a type of silicone oil). Here, the dimethyl silicone oil is an example of the non-volatile oil. An average particle size of the toner T is 3 μm to 6 μm, and the toner T may not infiltrate into the medium P at room temperature. On the other hand, the oil is liquid and thus may infiltrate into the medium P even at room temperature.

Regarding Non-Volatility

Here, non-volatility implies that a flash point thereof is 130° C. or higher or the amount of volatile matter in oil is 8% by weight or less after the oil is held at 150° C. for 24 hours.

Regarding Difference in SP Value Between Toner and Non-Volatile Oil

In addition, in the exemplary embodiment, a difference in SP value between the toner T and the oil O is from 1.5 to 7.0.

Method of Calculating SP Value

The SP value is a square root of cohesive energy density. In the exemplary embodiment, the SP values of the toner T and the oil O are obtained as follows.

The SP value is obtained using an estimation method of Van Krevelen and Hoftyzer. In this method, on the assumption that the cohesive energy density depends on the type and number of substituents, the SP value of a polymer is calculated in units of segments based on the respective cohesive energy values of the substituents. The cohesive energy calculated in this method is divided by the molar volume of the polymer to obtain a square root as a SP value (reference: "SP Value Fundamentals, Application, and Calculation method", Hideki Yamamoto, 2005, JOHOKIKO CO., LTD.).

The SP value obtained in this method is, by customary practice, a dimensionless value expressed by "$cal^{1/2}/cm^{3/2}$. Moreover, in this specification, a relative difference in SP value between two compounds has significance and thus is also expressed as a dimensionless value using the above-described values obtained by customary practice. For reference, when the SP value obtained using this method is expressed in SI units ($J^{1/2}/m^{3/2}$), the SP value needs to be multiplied by 2046.

Image Forming Operation

The image forming apparatus 10 forms an image as follows.

In the image forming unit 11K included in the image forming section 26K, the photoreceptor drum 12K rotates, and the outer peripheral surface of the photoreceptor drum 12K is charged by the charging device 14K. Next, the charged outer peripheral surface of the photoreceptor drum 12K is exposed by the exposure device 16K. As a result, an electrostatic latent image (not illustrated) of a first color (K) is formed on the outer peripheral surface of the photoreceptor drum 12. This electrostatic latent image is developed by the developing device 18K to form a toner image.

The toner image reaches the primary transfer position X1 along with the rotation of the photoreceptor drum 12K and is primarily transferred to the intermediate transfer roll 22K by the primary transfer voltage. At this time, the oil O (refer to FIG. 3A) is also transferred to the intermediate transfer roll 22K along with the toner T. The toner image transferred to the intermediate transfer roll 22K reaches the secondary transfer position X2 along with the rotation of the intermediate transfer roll 22K and is secondarily transferred to the medium P by the secondary transfer voltage. At this time, the oil O is also transferred to the medium P along with the toner T.

Likewise, toner image of a second color (C), a third color (M) and a fourth color (Y) which are formed by the image forming sections 26C, 26M, and 26Y are secondarily transferred to the medium P in order to overlap each other through the intermediate transfer rolls 22C, 22M, and 22Y.

After the toner image is finished being primarily transferred to the intermediate transfer roll 22K, the photoreceptor drum 12K is cleaned by a cleaner (not illustrated) to remove the oil O and the like remaining on the photoreceptor drum 12K. Likewise, the photoreceptor drums 12C, 12M, and 12Y are also cleaned by a cleaner (not illustrated) to remove the oil O and the like. In addition, after the toner image is finished being secondarily transferred to the medium P, the outer peripheral surface of the intermediate transfer roll 22K is cleaned by a cleaner (not illustrated) to remove the oil O and the like remaining on the intermediate transfer roll 22K. Likewise, the intermediate transfer rolls 22C, 22M, and 22Y are also cleaned by a cleaner (not illustrated) to remove the oil O and the like.

In addition, the toner T included in the toner image which is secondarily transferred to the medium P by the image forming section 26K is heated to the melting temperature of the toner T or higher by the heating device 80A. The toner T on the medium P is heated to the melting temperature of the toner T or higher and reaches the secondary transfer position X2 of the second color (C) along with the feeding of the medium P. The toner image of the second color (C) is secondarily transferred by the image forming section 26C to the medium P to which the toner image of the first color (K) is secondarily transferred. Next, the toner T included in the toner image, which is secondarily transferred to the medium P by the image forming sections 26K and 26C, is heated to the melting temperature of the toner T or higher by the heating device 80B and reaches the secondary transfer position X2 of the third color (M) along with the feeding of the medium P. The toner image of the third color (M) is secondarily transferred by the image forming section 26M to the medium P to which the toner images of the first color (K) and the second color (C) are secondarily transferred. Next, the toner T included in the toner image, which is secondarily transferred to the medium P by the image forming sections 26K, 26C, and 26M, is heated to the melting temperature of the toner T or higher by the heating device 80C and reaches the secondary transfer position X2 of the fourth color (Y). The toner image of the fourth color (Y) is secondarily transferred by the image forming section 26Y to the medium P to which the toner images of the first color (K), the second color (C), and the third color (M) are secondarily transferred. As described above, when the medium P to be fed passes through the secondary transfer position X2 of the fourth color (Y), a toner image (color toner image) in which the toner images of the respective colors overlap each other is formed on the medium P.

The medium P on which the toner image is formed is fed to the fixing device 40 by the feeding device 30. The medium P and the toner image on the medium P is heated by the auxiliary heating section 50. Next, a part of the oil O of the toner image on the medium P is removed by the oil removal section 60. Next, the toner image on the medium P from which a part of the oil O is removed is heated and pressed by the fixing section 70 to be fixed on the medium P.

When a monochromatic image is formed on the medium P, for example, when a black (K) image is formed on the medium P, the other image forming units 11C, 11M, and 11Y are retracted from the intermediate transfer rolls 22C, 22M, and 22Y, respectively.

Effects of Major Component (Heating Device)

Next, the effects of the major component (heating devices 80A, 80B, and 80C) of the exemplary embodiment will be described with reference to the accompanying drawings while compared to the following Embodiments (Embodiments 1 and 2). In the following description, when the same components and the like as those of the exemplary embodiment are used, the components and the like are represented by the same reference numerals.

Comparison to Embodiment 1

An image forming apparatus according to Embodiment 1 does not include the heating devices 80A, 80B, and 80C. The other points are the same as those of the configurations of the exemplary embodiment.

Figure 2A:
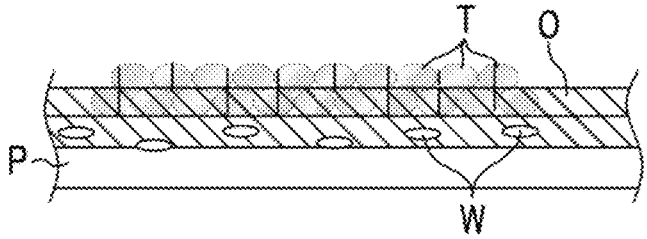
FIGS. 2A and 2B are schematic diagrams (cross-sectional views) of a comparative example illustrating a state of a developer and a medium before a toner image, which is formed on the medium by an image forming section, is transported to another image forming section.
Figure 2B:
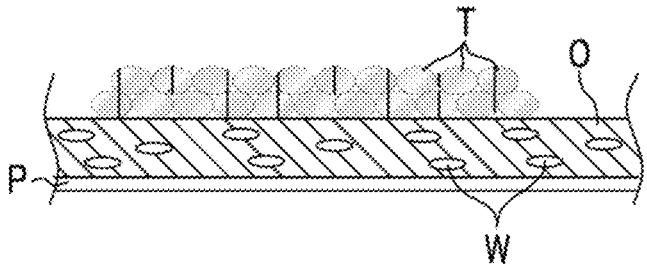

In the image forming apparatus according to Embodiment 1, as illustrated in FIGS. 2A and 2B, the toner T which is secondarily transferred to the medium P cannot infiltrate into the medium P. Therefore, the toner T which is secondarily transferred from the transfer roll 20K to the medium P is transported to the secondary transfer position X2 of the image forming section 26C while being attached on the medium P.

Further, as illustrated in FIG. 2A, a part of the oil O transferred along with the toner T, which is secondarily transferred from the transfer roll 20K included in the image forming section 26K to the medium P, infiltrates into the medium P. The medium P is further fed and by the time the medium P reaches the secondary transfer position X2 of the image forming section 26C, substantially all the oil O infiltrates into the medium P as illustrated in FIG. 2B.

In FIGS. 2A and 2B, the symbol W refers to water present in the medium P. In addition, the toner T is attached on the medium P while, for example, about two layers of the toner T are layered on the medium P. A state where the toner T is solidified is indicated by hatched lines, and a state where the toner T is molten is indicated by dots. The same shall be applied to FIGS. 3A to 3D described below.

In the secondary transfer position X2 of the image forming section 26C, the toner T of the second color (C) on the transfer roll 20C included in the image forming section 26C is secondarily transferred to a layer which is formed on the medium P using the toner T of the first color (K). In this case, as illustrated in FIG. 2B, particles of the toner T of the first color (K) overlap each other on the medium P in a state where substantially no oil O is present on the medium P. Therefore, an air layer (gaps) where substantially no oil O is present is formed between the particles of the toner T of the first color (K). In addition, a portion where the particles of the toner T of the first color (K) overlap each other is formed in a concave-convex shape. When the oil O and the toner T of the second color (C) overlap the portion where the particles of the toner T of the first color (K) overlap each other in the secondary transfer position X2, gaps are formed at a boundary between the layer of the toner T of the first color (K); and the toner T and the oil O of the second color (C). Since these gaps are formed in the secondary transfer position X2, the toner T of the second color (C) is not likely to be transferred to a portion of the medium P onto which the toner T of the second color should be secondarily transferred.

That is, when the gaps are formed between the particles of the toner T of the first color (K) in the secondary transfer position X2, the toner T of the second color (C) is not likely to be transferred to the portion of the medium P onto which the toner T of the second color should be secondarily transferred. The reason is presumed to be as follows. When the toner T of the second color (C) is secondarily transferred from the transfer roll 20C to the medium P, a force is applied to the toner T of the second color (C) by an electric field (hereinafter, referred to as "secondary transfer electric field) formed between the transfer roll 20C and the backup roll 24C. The secondary transfer electric field is formed at both layers including: gaps between the transfer roll 20C and the backup roll 24C; and a layer of the oil O. In this case, since the toner T is present in the oil layer on the transfer roll 20C, it is necessary that the toner T is applied with a force exceeding the surface tension of the oil so as to move from the oil layer into the gaps. For such a reason, when the gaps are formed in the secondary transfer position X2, the toner T of the second color (C) is not likely to be transferred to the portion of the medium P onto which the toner T of the second 21. color should be secondarily transferred.

On the other hand, in the image forming apparatus 10 according to the exemplary embodiment, the heating device 80 that heats the toner T on the medium P to the melting temperature of the toner T or higher is arranged on a downstream side of the image forming section 26K and on an upstream side of the image forming section 26C in the feeding direction of the medium P. Therefore, in the image forming apparatus 10 according to the exemplary embodiment, the toner T which is secondarily transferred from the transfer roll 20K to the medium P and the oil O which is transferred along with the toner T show different behaviors from those of the image forming apparatus according to a comparative example. Hereinafter, these different behaviors will be described with reference to FIGS. 3A to 3D.

Figure 3B:
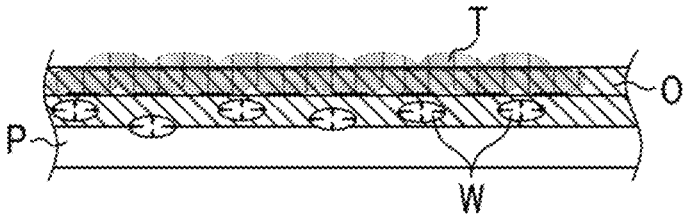
Figure 3C:
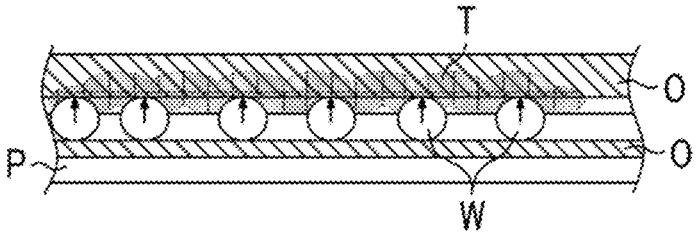
Figure 3D:
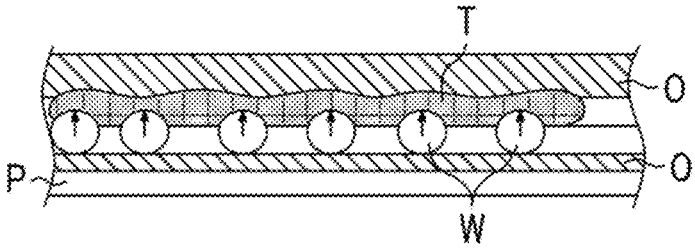

First, as illustrated in FIG. 3A, a part of the oil O transferred along with the toner T, which is secondarily transferred from the transfer roll 20K included in the image forming section 26K to the medium P, infiltrates into the medium P. This point is the same as that of the image forming apparatus according to a comparative example. However, as illustrated in FIG. 3B, the toner T which is heated to the melting temperature of the toner T or higher by the heating device 80A that heats the toner T on the medium P to the melting temperature of the toner T or higher is changed from the solidified state to the molten state. In addition, as illustrated in FIG. 3B, the water W present in the medium P is heated by the heating device 80A and thus starts to be gasified. Next, as illustrated in FIG. 3C, the toner T and the oil O repel to each other due to a difference between the SP value of the toner T and the SP value of the oil O and thus start to be separated from each other. In addition, since the affinity of the toner T to the medium P is higher than that of the oil O to the medium P, a layer in which the toner T is melted is formed on the medium P as an underlayer, and an oil layer is formed on the layer in which the toner T is melted as an upper layer. The gasified water W has a function of secondarily pushing out the oil O, which infiltrates into the medium P, from the medium P. In other words, until the medium P reaches the secondary transfer position X2 of the image forming section 26C, the toner T, which is secondarily transferred from the transfer roll 20K to the medium P, and the oil O, which is transferred along with the toner T, form two separated layers including a layer in which the toner T is melted and an oil layer on the medium P in this order. In this way, in the image forming apparatus 10 according to the exemplary embodiment, the layer in which the toner T is melted is formed on the medium P. Therefore, the oil O included in the oil layer, which is formed on the outermost surface of the layer in which the toner T is melted, is not likely to infiltrate into the medium P from the layer in which the toner T is melted.

Accordingly, in the case of the image forming apparatus 10 according to the exemplary embodiment, in the secondary transfer position X2 of the image forming section 26C, the toner T of the second color (C) on the transfer roll 20C included in the image forming section 26C is secondarily transferred to the flat oil layer. In other words, in the case of the image forming apparatus 10 according to the exemplary embodiment, in a region between the toner T of the second color (C) and the flat oil layer, gaps are not likely to be formed between the particles of the toner T of the first color (K) as compared to the image forming apparatus according to Embodiment 1. In addition, in the secondary transfer position X2 of the image forming section 26C, the toner T of the second color (C) and the oil O come into contact with the flat oil layer to form the secondary transfer electric field. Therefore, the toner T of the second color (C) is likely to be transported through the oil layer (is likely to be transported through the oil layer by electrophoresis) as compared to the image forming apparatus according to Embodiment 1. Therefore, in the case of the image forming apparatus 10 according to the exemplary embodiment, the toner T of the second color (C) is likely to be transferred to the portion of the medium P onto which the toner T of the second color should be secondarily transferred as compared to the toner T of the second color (c) of the image forming apparatus according to Embodiment 1.

Accordingly, in the image forming apparatus 10 according to the exemplary embodiment, as compared to the image forming apparatus according to Embodiment 1, secondary transfer failure is prevented in the image forming section 26C on a downstream side of the image forming section 26K in the feeding direction of the medium P.

Likewise, in the image forming apparatus 10 according to the exemplary embodiment, the heating device 80B that heats the toner T on the medium P to the melting temperature of the toner T or higher is arranged on a downstream side of the image forming section 26C and on an upstream side of the image forming section 26M in the feeding direction of the medium P. Accordingly, in the image forming apparatus 10 according to the exemplary embodiment, as compared to the image forming apparatus according to Embodiment 1, secondary transfer failure is prevented in the image forming section 26M on a downstream side of the image forming section 26C in the feeding direction of the medium P.

Likewise, in the image forming apparatus 10 according to the exemplary embodiment, the heating device 80C that heats the toner T on the medium P to the melting temperature of the toner T or higher is arranged on a downstream side of the image forming section 26M and on an upstream side of the image forming section 26Y in the feeding direction of the medium P. Accordingly, in the image forming apparatus 10 according to the exemplary embodiment, as compared to the image forming apparatus according to Embodiment 1, secondary transfer failure is prevented in the image forming section 26Y on a downstream side of the image forming section 26M in the feeding direction of the medium P.

In addition, in the image forming apparatus 10 according to the exemplary embodiment, as illustrated in FIG. 1, the heating device 80A is arranged on a downstream side of the first image forming section 26K and on an upstream side of the second image forming section 26C from the most upstream side in the feeding direction of the medium P.

Accordingly, in the image forming apparatus 10 according to the exemplary embodiment, as compared to the image forming apparatus according to Embodiment 1, secondary transfer failure is prevented in the second and subsequent image forming sections (image forming sections 26C, 26M, and 26Y).

Comparison to Embodiment 2

In an image forming apparatus according to Embodiment 2, different oil is used. Therefore, in the image forming apparatus according to Embodiment 2, a difference in SP value between the toner T and the oil is not in the range from 1.5 to 7.0. The other points of Embodiment 2 are the same as those of the configurations of the exemplary embodiment. Embodiment 2 is included in the technical scope of the invention.

In the image forming apparatus according to Embodiment 2, when the difference in SP value between the toner T and the oil is less than 1.5, the toner T is likely to be melted in the oil. Therefore, even when the toner T is heated to the melting temperature or higher by the heating device 80A, two layers including the layer in which the toner T is melted and the oil layer are not likely to be separately formed on the medium P in this order.

In the image forming apparatus according to Embodiment 2, when the difference in SP value between the toner T and the oil is more than 7.0, the toner T and the oil are likely to be excessively separated from each other. In other words, the dispersibility of the toner T in the oil is likely to be decreased. Therefore, in the developing process, the dispersibility of the toner T in the oil is out of an allowable range, and a toner image developed on the photoreceptor drum 12 is likely to be uneven.

On the other hand, in the image forming apparatus 10 according to the exemplary embodiment, a difference in SP value between the toner T and the oil O is from 1.5 to 7.0. Therefore, when the toner T is heated to the melting temperature or higher by the heating device 80A, two layers including the layer in which the toner T is melted and the oil layer are likely to be separately formed on the medium P in this order.

In addition, in the image forming apparatus 10 according to the exemplary embodiment, a difference in SP value between the toner T and the oil O is from 1.5 to 7.0. Therefore, in the developing process by the developing device 18, the dispersibility of the toner T in the oil is within an allowable range, and a uniform toner image within an allowable range is formed on the photoreceptor drum 12.

Accordingly, in the image forming apparatus 10 according to the exemplary embodiment, as compared to the image forming apparatus according to Embodiment 2, an oil layer is likely to be formed on the outside of a layer in which the toner T is melted, and a uniform toner image within an allowable range can be formed.

In addition, in the image forming apparatus according to Embodiment 2, when the difference in SP value between the toner T and the oil is less than 1.5, the toner T is likely to be melted in the oil. In other words, the oil remains in an image (layer in which the toner T is fixed) which is fixed on the medium P. As a result, the image which is fixed on the medium P is likely to be peeled off.

On the other hand, in the image forming apparatus 10 according to the exemplary embodiment, a difference in SP value between the toner T and the oil O is from 1.5 to 7.0. Therefore, in the fixing process by the fixing device 40, since the oil is likely to be separated from gaps between particles of the toner T, the oil O is not likely to remain in the image fixed on the medium P. Accordingly, in the image on the medium P which is formed by the image forming apparatus 10 according to the exemplary embodiment, a bonding strength between the particles of the toner T is higher than that of a case where a difference in SP value between the toner T and the oil is less than 1.5.

Accordingly, according to the image forming apparatus 10 of the exemplary embodiment, an image fixed on the medium P is not likely to be peeled off as compared to the image forming apparatus according to Embodiment 2.

In addition, in the image forming apparatus 10 according to the exemplary embodiment, the toner T contains a polyester resin, and the oil O contains silicone oil. Accordingly, according to the image forming apparatus 10 of the exemplary embodiment, an oil layer is likely to be formed on the outside of a layer in which the toner is melted, as compared to an image forming apparatus in which the toner T does not contain a polyester resin, and the oil. 0 does not contain silicone oil.

As described above, the invention has been described in detail using the specific exemplary embodiment. However, the invention is not limited to the above-described exemplary embodiments, and other exemplary embodiments can be adopted within the scope of the invention.

For example, in the exemplary embodiment, the non-volatile oil is silicone oil but may not be silicone oil as long as conditions of the non-volatile oil (for example, a flash point thereof is 130° C. or higher) are satisfied. For example, paraffin-based oil, ether-based oil, plant-based oil, and other oils which satisfy the above-described conditions may also be used. In addition, a mixed oil of plural types of the above-described oils may also be used.

In addition, in the image forming apparatus 10 according to the exemplary embodiment, the four image forming sections 26 of the first color (K) to the fourth color (Y) are provided. However, another configuration may also be adopted in which at least two image forming sections 26 of two or more colors are provided and the heating device 80 is provided between two image forming sections 26.

In addition, in the image forming apparatus 10 according to the exemplary embodiment, the heating devices 80A, 80B, and 80C are arranged between the image forming section 26K and the image forming section 26C, between the image forming section 26C and the image forming section 26M, and between the image forming section 26M and the image forming section 26Y, respectively. However, in the image forming apparatus according to the invention, it is not necessary that all the heating devices 80A, 80B, and 80C be arranged, and only one of the heating devices 80A, 80B, and 80C may be arranged. In this case, it is preferable that the heating device 80 be arranged between the image forming section 26K and the image forming section 26C, that is, be arranged on a downstream side of the first image forming section 26K and on an upstream side of the second image forming section 26C from the most upstream side in the feeding direction of the medium P. In this way, since the heating device 80 is arranged between the image forming section 26K and the image forming section 26C, a layer in which the toner T of the first color (K) is melted is formed on the medium P after the toner image of the first color (K) is secondarily transferred to the medium P. Therefore, when the toner images of the second color (C) to the fourth color (Y) are secondarily transferred, the oil O transferred along with the toner image is not likely to infiltrate into the medium P, due to the layer which is formed on the medium P and in which the toner T of the first color (K) is melted.

In addition, each of the image forming sections 26 according to the exemplary embodiment includes the transfer device 20. However, as long as the respective heating devices 80 are arranged between the respective image forming units 11, the toner image formed on the photoreceptor drum 12 may be directly transferred to the medium P to be fed.

In addition, in the image forming apparatus 10 according to the exemplary embodiment, the image forming sections 26K, 26C, 26M, and 26Y are arranged in this order in the feeding direction of the medium P. However, as long as the heating device 80 is arranged between two arbitrary image forming sections 26, the arrangement of the image forming sections 26K, 32. 26C, 26M, and 26Y may be different from that of the image forming apparatus 10 according to the exemplary embodiment.

Method of Measuring Various Properties

First, a method of measuring properties of the toner and the like used in Examples and Comparative Examples will be described.

Molecular Weight of Resin

The molecular weight of a resin is measured under the following conditions. As a GPC, "HLC-8120GPC, SC-8020 (manufactured by Tosoh Corporation)" are used. As a column, two columns of "TSKgel, Super HM-H (manufactured by Tosoh Corporation; 6.0 mm ID×15 cm) are used. As an eluent, tetrahydrofuran (THF) is used. The experiment is performed using a refractive index (RI) detector under experimental conditions of a sample concentration of 0.5%, a flow rate of 0.6 ml/min, a sample injection amount of 10 μl, and a measurement temperature of 40° C. In addition, a calibration curve is prepared from 10 samples, "Polystyrene Standard Sample TSK Standard": "A-500", "F-1", "F-10", "F-80", "F-380", "A-2500", "F-4", "F-40", "F-128", and "F-700" (manufactured by Tosoh Corporation).

Volume Average Particle Sizes of Toner, Resin Particles, Colorant Particles, and the Like The volume average particle sizes of the toner, resin particles, colorant particles, and the like are measured using the following method.

When particle sizes of target particles are 2 μm or more, the particle sizes are measured by using Coulter Multisizer II (manufactured by Beckman Coulter Co., Ltd.) as a measuring device and using ISOTON-II (manufactured by Beckman Coulter Co., Ltd.) as an electrolytic solution.

In this measurement method, from 0.5 mg to 50 mg of a measurement sample is added to a surfactant as a disperser, preferably, to from 2 ml of 5% aqueous sodium alkylbenzene sulfonate solution, and this solution is added to from 100 ml to 150 ml of the electrolytic solution. The electrolytic solution in which the measurement sample is suspended is dispersed with an ultrasonic disperser for 1 minute. Then, a particle size distribution of particles having a particle size in a range of 2.0 μm to 60 μm is measured using Multisizer II and an aperture having an aperture size of 100 μm. The number of the target particles is 50,000.

Using the measured particle size distribution, volume and number cumulative distributions are drawn respectively on divided particle size ranges (channels) from the smallest particle size. A particle size having a cumulative value of 16% by volume is defined as a vol ume average particle size D16v, and a particle size having a cumulative value of 16% by number is defined as a number average particle size D16p. In addition, a particle size having a cumulative value of 50% by volume is defined as a volume average particle size D50v, a particle size having a cumulative value of 50% by number is defined as a number average particle size D50p, a particle size having a cumulative value of 84% by volume is defined as a volume average particle size D84v, and a particle size having a cumulative value of 84% by number is defined as a number average particle size D84p. The volume average particle size is D50v.

Using the above values, a volume average particle size distribution index (GSDv) is calculated from $(D84v/D16v)^{1/2}$, a number average particle size distribution index (GSDp) is calculated from $(D84p/D16p)^{1/2}$, and a lower number average particle size distribution index (lower GSDp) is calculated from {(D50p)/(D16p)}.

On the other hand, when particle sizes of target particles are less than 2 μm, the particle sizes are measured using a laser diffraction particle size distribution analyzer (LA-700, manufactured by Horiba Ltd.). In this measurement method, a dispersion of a sample having a solid content of 2 g is prepared, and ion exchange water is added to the dispersion such that the total amount thereof is 40 ml. This solution is poured into a cell until an appropriate concentration is obtained, and is held for 2 minutes. Once the concentration in the cell is stabilized, the measurement is performed. The obtained volume average particle sizes for the respective channels are accumulated from the smallest volume average particle size, and a particle size having a cumulative value of 50% is obtained as a volume average particle size.

Glass Transition Temperature and Melting Temperature of Resin

A glass transition temperature (Tg) and a melting temperature (Tm) are obtained from respective main peaks measured according to ASTMD 3418-8. The glass transition temperature is a temperature at an intersection between an extended line of the base line and extended line of the rising line in the endothermic section, and the melting temperature is a peak temperature of the endothermic peak. For the measurement, a differential scanning calorimeter (DSC-7, manufactured by PerkinElmer Co., Ltd.) is used.

Preparation of Toner

Preparation of Amorphous Polyester Resin (1) and Amorphous Resin Particle Dispersion (1a)

| | |
|---|---|
| Polyoxyethylene(2,0)-2,2-bis(4-hydroxyphenyl) propane | 35 parts by mole |
| Polyoxypropylene(2,2)-2,2-bis(4-hydroxyphenyl)propane | 65 parts by mole |
| Terephthalic acid | 80 parts by mole |
| N-dodecenyl succinic acid | 15 parts by mole |
| Trimellitic acid | 10 parts by mole |

The above-described components and 0.05 part by mole of dibutyltin oxide with respect to the acidic components (the total molar number of terephthalic acid, n-dodecenyl succinic acid, and trimellitic acid) of the above-described components are put into a heated and dried two-necked flask. Nitrogen gas is introduced into the container such that the container is held in an inert atmosphere, and the container is heated, followed by a condensation polymerization reaction at from 150° C. to 230° C. for 12 hours. Next, the pressure is slowly reduced at from 210° C. to 250° C. As a result, an amorphous polyester resin (1) is synthesized.

When the molecular weight (in terms of polystyrene) of the amorphous polyester resin (1) is measured by gel permeation chromatography (GPC), the weight average molecular weight (Mw) thereof is 15,000, and the number average molecular weight (Mn) thereof is 6,800.

In addition, when the amorphous polyester resin (1) is measured using a differential scanning calorimeter (DSC), not a distinct peak but a stepwise change in the endothermic caloric value is shown. The glass transition temperature which is positioned at the intermediate point in the stepwise change in the endothermic caloric value is 62° C.

3,000 parts of the obtained amorphous polyester resin (1), 10,000 parts of ion exchange water, 90 parts of sodium dodecylbenzenesulfonate as a surfactant are put into an emulsification tank of a high-temperature and high-pressure emulsification device (CAVITRON CD1010, slit: 0.4 mm), are heated and melted at 130° C., are dispersed at 0.110° C. for 30 minutes at a flow rate of 3 L/m and 10,000 rpm. The obtained solution is allowed to pass through a cooling tank and an amorphous resin particle dispersion is collected, and thereby an amorphous resin particle dispersion (1a) is obtained.

In resin particles included in the obtained amorphous resin particle dispersion (1a), the volume average particle size D50v is 0.3 μm and the standard deviation is 1.2.

Preparation of Crystalline Polyester Resin (2) and Crystalline Resin Particle Dispersion (2a)

| | |
|---|---|
| 1,4-butanediol (manufactured by Wako Pure Chemical Industries Ltd.) | 293 parts |
| Dodecane dicarboxylic acid (manufactured by Wako Pure Chemical Industries Ltd.) | 750 parts |
| Catalyst (dibutyltin oxide) | 0.3 part |

The above-described components are put into a heated and dried three-necked flask. Nitrogen gas is introduced into the container through a decompression operation such that the container is in an inert atmosphere, followed by mechanical stirring at 180° C. for 2 hours. Next, the solution is gradually heated to 230° C. under reduced pressure, followed by stirring for 5 hours until the solution is viscous. Then, the solution is air-cooled and the reaction is stopped. As a result, a crystalline polyester resin (2) is synthesized.

When the molecular weight (in terms of polystyrene) of the crystalline polyester resin (2) is measured by gel permeation chromatography (GPC), the weight average molecular weight (Mw) thereof is 18,000.

In addition, when the melting temperature (Tm) of the crystalline polyester resin (2) is measured using a differential scanning calorimeter (DSC) with the above-described measurement method, a distinct peak is shown, and a peak temperature is 70° C.

Further, a crystalline resin particle dispersion (2a) is prepared under the same conditions as those of the resin particle dispersion (1a), except that the crystalline polyester resin (2) is used. In particles included in the obtained dispersion, the volume average particle size D50v is 0.25 μm and the standard deviation is 1.3.

Preparation of Colorant Dispersion (1)

| | |
|---|---|
| Phthalocyanine pigment (PVFASTBLUE, manufactured by Dainichiseika Color & Chemicals Co., Ltd.) | 25 parts |
| Anionic surfactant (NEOGEN RK, manufactured by Daiichi Kogyo Seiyaku Co., Ltd.) | 2 parts |
| Ion exchange water | 125 parts |

The above-described components are mixed and dissolved, followed by dispersing with a homogenizer (Ultra Turrax, manufactured by IKA). As a result, a colorant dispersion (1) is obtained.

Preparation of Release Agent Particle Dispersion (1)

Pentaerythritol behenic acid tetraester wax 100 parts

Anionic surfactant (NEWLEX R, NOF Corporation) 2 parts

Ion exchange water 300 parts

The above-described components are mixed and dissolved, followed by dispersing with a homogenizer (Ultra Turrax, manufactured by IKA) and dispersing with a pressure discharging homogenizer. As a result, a release agent particle dispersion (1) is obtained.

Preparation of Inorganic Particle Dispersion (1)

| | |
|---|---|
| Hydrophobic silica (RX200, manufactured by Nippon Aerosil Co., Ltd.) | 100 parts |
| Anionic surfactant (NEWLEX R, NOF Corporation) | 2 parts |
| Ion exchange water | 1000 parts |

The above-described components are mixed and dissolved, followed by dispersing with a homogenizer (Ultra Turrax, manufactured by IKA) and dispersing with a ultrasonic homogenizer (RUS-600CCVP, manufactured by Nissei Corporation) through 200 passes. As a result, an inorganic particle dispersion (1) is obtained.

Preparation of Toner (1)

| | |
|---|---|
| Amorphous resin particle dispersion (1a) | 145 parts |
| Crystalline resin particle dispersion (2a) | 30 parts |
| Colorant dispersion (1) | 42 parts |
| Release agent particle dispersion (1) | 36 parts |
| Inorganic particle dispersion (1) | 10 parts |
| Aluminum sulfate (manufactured by Wako Pure Chemical Industries Ltd.) | 0.5 part |
| Ion exchange water | 300 parts |

The above-described components are put into a round stainless steel flask, and the pH of the solution is adjusted to 2.7, followed by dispersing with a homogenizer (Ultra Turrax T50, manufactured by IKA) and heating in a heating oil bath to 45° C. under stirring. The pH of the dispersion is 3.2. After being held at 48° C., the dispersion is appropriately observed using an optical microscope to confirm that aggregated particles having a particle size of 3.8 μm are formed. IN aqueous sodium hydroxide solution is gently added to the dispersion to adjust the pH to 8.0, followed by heating to 90° C. under continuous stirring. This state is held for 3 hours. Next, a reaction product is separated by filtration and washed with ion exchange water, followed by drying using a vacuum dryer. As a result, toner particles (1) are obtained.

The volume average particle size D50v of the obtained toner particles (1) is 3.8 μm. 1 part of gas phase silica (R972, manufactured by Nippon Aerosil Co., Ltd.) is mixed by a Henschel mixer and externally added to 100 parts of the toner particles. As a result, toner (1) is obtained.

EXAMPLES

In the following two types of oils, images (hereinafter, referred to as "fixed images") obtained by the toner T being fixed on the medium P under an oil-rich condition are formed using the following method, and cross-sectional images of the fixed images are observed.

Example 1

As the oil O, dimethyl silicone oil (KF-96-20cs, manufactured by Shin-Etsu Chemical Co., Ltd., SP value: 7.2) is used. In addition, as the toner T, the toner (1) is used. The SP value of the toner (1) is 9.0. Therefore, in Example 1, a difference in SP value between the toner T and the oil O is 1.8.

Using a bar coater, a liquid developer having a concentration of 30% is applied to a polyethylene terephthalate film (an example of the medium F) to form a sample film (the weight of toner (TMA1)=8.7 g/m$^2$) thereon. At this time, the weight of the oil (CMA1) is 20.3 g/m$^2$. Using a hot plate, a back surface (a surface of the polyethylene terephthalate film to which the liquid developer is not applied) of the sample film is heated to 80° C. for 3 minutes such that the toner T is fixed on the polyethylene terephthalate film.

Example 2

As the oil O, liquid paraffin oil. (MORESCO WHITE P40, manufactured by Matsumura Oil Co., Ltd., SPvalue: 7.9) is used. In addition, as the toner T, the toner (1) is used. The SP value of the toner (1) is 9.0. Therefore, in Example 2, a difference in SP value between the toner T and the oil O is 1.1.

Using a bar coater, a liquid developer having a concentration of 30% is applied to a polyethylene terephthalate film (an example of the medium P) to form a sample film (the weight of toner (TMA1)=9.7 g/m$^2$) thereon. At this time, the weight of the oil (CMA1) is 22.6 g/m$^2$. Using a hot plate, a back surface (a surface of the polyethylene terephthalate film to which the liquid developer is not applied) of the sample film is heated to 80° C. for 3 minutes such that the toner T is fixed on the polyethylene terephthalate film.

Result and Review

Figure 4:
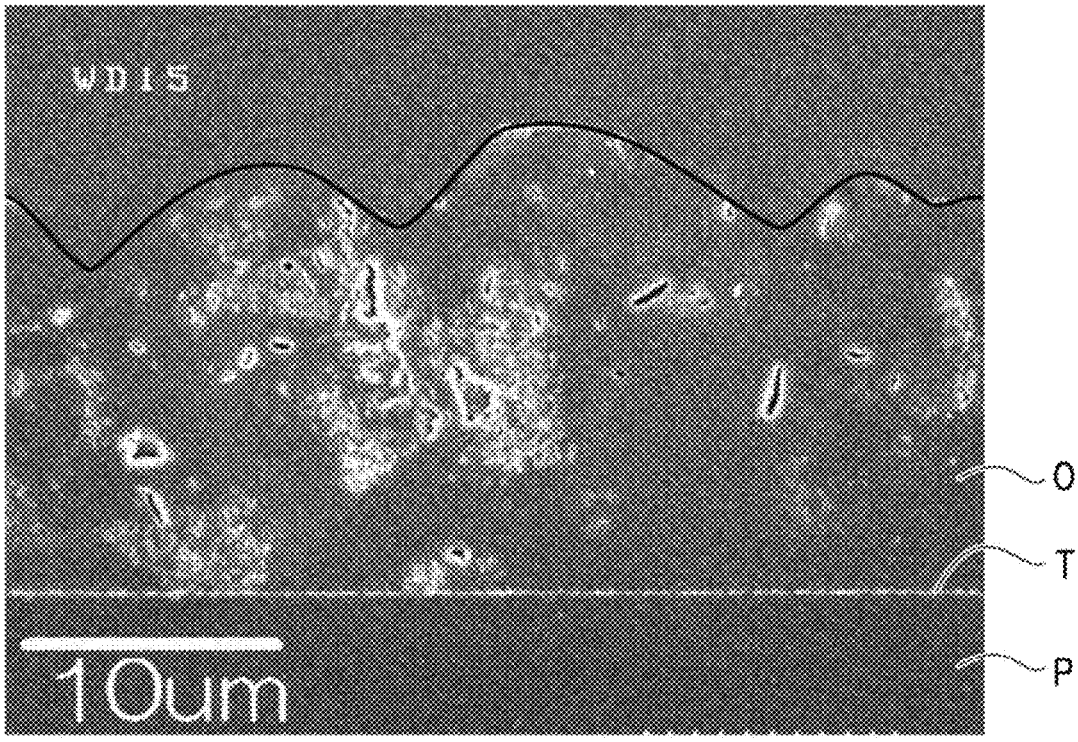
FIG. 4 is a cross-sectional view (cross-sectional image) of an example according to an exemplary embodiment of the invention illustrating a medium and a toner image fixed on the medium (wherein toner containing a polyester resin as a major component is used, dimethyl silicone oil is used as non-volatile oil, and a difference in SP value between the toner and the oil is 3.0)

In Example 1, as illustrated in FIG. 4, it is considered that dimethyl silicone oil does not remain in the fixed image. In addition, in Example 1, it is considered that particles of the toner T are efficiently melted. The solid line indicates the surface of the oil layer.

Figure 5:
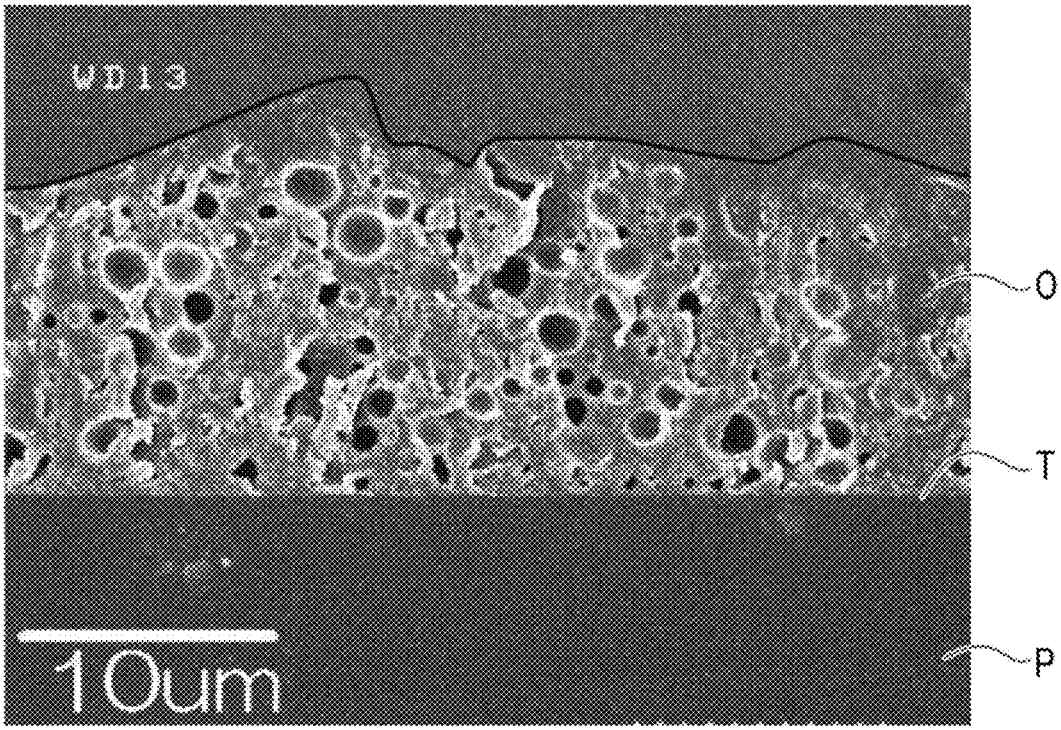
FIG. 5 is a cross-sectional view (cross-sectional image) of another example according to the exemplary embodiment illustrating a medium and a toner image fixed on the medium (wherein toner containing a polyester resin as a major component is used, liquid paraffin oil is used as non-volatile oil, and a difference in SP value between the toner and the oil is 2.1).

In Example 2, as illustrated in FIGS. 4 and 5, it is considered that liquid paraffin oil remains in the fixed image as compared to Example 1. In addition, in Example 2, as compared to Example 1, it is considered that particles of the toner T are not sufficiently melted due to the liquid paraffin oil remaining in the fixed image. The solid line indicates the surface of the oil layer.

As described above, it is considered that the combination of the toner T and the oil O of Example 1 is superior to the combination of the toner T and the oil CO of Example 2. However, in either case, when an image is formed using the image forming apparatus 10, secondary transfer failure does not occur in the image forming sections 26C, 26M, and 26Y on a downstream side.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming sections that form a toner image on a medium to be fed using a developer containing toner and non-volatile oil; and a heating unit that is arranged (1) on a downstream side of an image forming section arranged on an upstream side in a feeding direction of the medium, and (2) on an upstream side of an image forming section arranged on a downstream side in the feeding direction, among the plurality of image forming sections, wherein the heating unit heals the toner on the medium to a melting temperature of the toner or higher, and wherein a difference in solubility parameter (SP) value between toner and non-volatile oil contained in a developer, which is used in an image forming section on an upstream side of the heating unit in the feeding direction, among the developers of the plurality of the image forming sections, is 1.8 to 7.0.

2. The image forming apparatus according to claim 1, wherein the number of the image forming sections is three or more, and the heating unit is arranged on a downstream side of a first image forming section and on an upstream side of a second image forming section from the most upstream side in the feeding direction.

3. The image forming apparatus according to claim 1, wherein the toner contains a polyester resin, and the non-volatile oil contains silicone oil.

4. The image forming apparatus according to claim 2, wherein the toner contains a polyester resin, and the non-volatile oil contains silicone oil.

5. The image forming apparatus according to claim 1, wherein the heating unit is fully arranged on a side of the medium to be fed opposite that from the plurality of image forming sections.

* * * * *